US009243824B2

(12) United States Patent
Wolfe, IV et al.

(10) Patent No.: US 9,243,824 B2
(45) Date of Patent: Jan. 26, 2016

(54) INTERNAL HEAT EXCHANGER ASSEMBLY HAVING AN INTERNAL BLEED VALVE ASSEMBLY

(75) Inventors: Edward Wolfe, IV, E Amherst, NY (US); Prasad S. Kadle, Williamsville, NY (US); Carrie M. Kowsky, Lockport, NY (US); James A. Bright, Gasport, NY (US); Timothy D. Craig, Williamsville, NY (US); Gregory J. Kowalski, Cambria, NY (US); Mark J. Zima, Clarence Center, NY (US); Nick G. Sabha, Lewiston, NY (US)

(73) Assignee: DELPHI TECHNOLOGIES, INC., Troy, MI (US)

( * ) Notice: Subject to any disclaimer, the term of this patent is extended or adjusted under 35 U.S.C. 154(b) by 553 days.

(21) Appl. No.: 13/126,786

(22) PCT Filed: Oct. 29, 2009

(86) PCT No.: PCT/US2009/062467

§ 371 (c)(1),
(2), (4) Date: Nov. 21, 2011

(87) PCT Pub. No.: WO2010/051333

PCT Pub. Date: May 6, 2010

(65) Prior Publication Data

US 2012/0055195 A1 Mar. 8, 2012

Related U.S. Application Data

(60) Provisional application No. 61/109,269, filed on Oct. 29, 2008.

(51) Int. Cl.
*F25B 41/00* (2006.01)
*F25B 40/00* (2006.01)

(Continued)

(52) U.S. Cl.
CPC ..... *F25B 40/00* (2013.01); *F28D 7/024* (2013.01); *F28D 7/10* (2013.01); *F25B 2400/0411* (2013.01); *F25B 2400/05* (2013.01); *F25B 2500/12* (2013.01); *F28F 2265/28* (2013.01)

(58) Field of Classification Search
CPC ..... F25B 40/00–40/06; F28D 7/024; F28D 7/10
USPC ..... 137/115.16, 517; 62/197, 513, 196, 62/196.1, 196.4, 217, 512, 113; 165/156, 165/42, 103, 281–286
See application file for complete search history.

(56) References Cited

U.S. PATENT DOCUMENTS 1,869,637 A * 8/1932 Walworth ..... 165/103
2,855,346 A 10/1958 Williamson (Continued)

OTHER PUBLICATIONS

PCT/US2009/062467 International Search Report.

*Primary Examiner* — Marc Norman
*Assistant Examiner* — Antonio R Febles
(74) *Attorney, Agent, or Firm* — Brinks Gilson & Lione

(57) ABSTRACT

An internal heat exchanger assembly for an air conditioning system, having a substantial cylindrical cavity in which a helical coil tube is coaxially disposed within the cylindrical cavity. A bleed valve assembly is incorporated into the helical coiled tube, in which the bleed valve assembly is adapted to open at a predetermined differential pressure between the high pressure side and low pressure side of the internal heat exchanger. The bleed valve selectively bleeds refrigerant from the high pressure side to the low pressure side, thereby increasing the pressure and mass flow rate of the refrigerant to the suction side of a compressor.

4 Claims, 4 Drawing Sheets

(51) Int. Cl.
*F28D 7/02* (2006.01)
*F28D 7/10* (2006.01)

(56) References Cited

U.S. PATENT DOCUMENTS 3,999,570 A * 12/1976 Clements ..... 137/517
4,300,357 A * 11/1981 Jacyno ..... 62/239
5,363,664 A 11/1994 Beakley et al.
5,761,926 A * 6/1998 Luis ..... 62/513
5,873,779 A * 2/1999 Raccouard ..... 454/158
6,327,868 B1 * 12/2001 Furuya et al. ..... 62/197
6,935,126 B2 8/2005 Ito et al.
7,089,760 B2 * 8/2006 Ichimura et al. ..... 62/513
2002/0139136 A1 10/2002 Noble, III
2006/0037351 A1 2/2006 Kim et al.
2006/0225459 A1 * 10/2006 Meyer ..... 62/512

* cited by examiner

INTERNAL HEAT EXCHANGER ASSEMBLY HAVING AN INTERNAL BLEED VALVE ASSEMBLY

CROSS REFERENCE TO RELATED APPLICATION

This application claims the benefit of U.S. Provisional Patent Application Ser. No. 61/109,269 for a Spiral Heat Exchanger, filed on Oct. 29, 2008, which is hereby incorporated by reference in its entirety. This claim is made under 35 U.S.C. §119(e); 37 C.F.R. §1.78; and 65 Fed. Reg. 50093.

TECHNICAL FIELD OF INVENTION

The invention relates to an internal heat exchanger assembly for an automotive air conditioning system; more particularly, to an internal heat exchanger assembly having an internal bleed valve assembly; and still more particularly, to an internal heat exchanger assembly having an internal bleed valve assembly that selectively by-passes refrigerant from the high pressure side to the low pressure side.

BACKGROUND OF INVENTION

A typical automotive air conditioning system includes a compressor, a condenser, an expansion device, and an evaporator. Hydraulically connecting the aforementioned components are series of refrigerant tubes that are capable of conveying a two phase refrigerant operating under high and low pressure flows. An exemplary two phase refrigerant commonly used in a typical modern automotive air conditioning system is an environmentally friendly refrigerant known as R-134a and low Global Warming Potential (GWP) refrigerants such as HFO-1234yf.

The compressor is commonly referred to as the heart of the air conditioning system in which it is responsible for compressing and transferring the refrigerant throughout the system. The compressor includes a suction side having a suction reed valve assembly and a discharge side having a discharge reed valve assembly. The main inner volume of the compressor, the so called crankcase, is substantially hollow, but numerous moving components are either contained in or exposed to the refrigerant, such as the central drive shaft, shaft support bearings, swash plate, and reciprocating variable displacement pistons.

The evaporator is disposed in the passenger cabin of the automobile and the condenser is disposed in the front portion of the engine compartment or more precisely, in front of the radiator exposed to the outside ambient air. Heat energy from the passenger cabin is absorbed by the refrigerant in the evaporator and conveyed to the condenser where it is dispelled to the ambient air. Within the evaporator, a low pressure liquid refrigerant (LPLR) expands into a low pressure vapor refrigerant (LPVR) by absorbing heat energy from the passenger cabin. The LPVR exiting from the evaporator is drawn by the compressor and compressed into a high pressure vapor refrigerant (HPVR). The compressed HPVR is then discharged by the compressor to the condenser. As the HPVR passes through the condenser, the refrigerant is condensed into a high pressure liquid refrigerant (HPLR) as it releases the heat it absorbed from the passenger cabin to the ambient air outside of the automobile. Exiting the condenser, the HPLR passes through an expansion device that regulates the flow of the now LPLR to the evaporator to repeat the process of heat transfer from the cabin to the outside ambient air.

The temperature of the returning LPVR to the compressor from the evaporator is typically 40° F. to 100° F. lower than the HPLR exiting the condenser. An internal heat exchanger, such as the internal heat exchange having an internal spiraled or helical tube disclosed in U.S. patent application Ser. No. 12/487,709 is used to take advantage of the temperature differential between the lower temperature LPVR and the higher temperature HPLR to improve the overall cooling capacity of the air conditioning system. The internal heat exchanger includes an outer pipe and a co-axially located helical coiled tube located within the outer pipe. The relatively cooler LPVR exiting the evaporator is passed through the outer pipe and the relatively hotter HPLR exiting the condenser is passed through the helical coiled tube. Heat is transferred from the HPLR exiting the condenser to the cooler LPVR returning to the compressor in the internal heat exchanger. By decreasing the temperature of the HPLR prior to it flowing through the expansion device, the expansion device may be set at a lower temperature; therefore the temperature of the LPLR entering the evaporator is at a lower temperature to increase cooling efficiency of the air conditioning system.

During periods of low demand on an automotive air conditioning system, the mass flow rate of the LPVR entering the suction side of the compressor would occasionally drop below a certain threshold which would cause what is commonly referred to as compressor pulsation rattle. The compressor experiences pulsation rattle due to the suction reed becoming unstable by fluctuating between a partially opened and closed position. The fluctuating suction reed sends an acoustic wave upstream through the system's refrigerant tubes and internal heat exchanger toward the evaporator. The evaporator amplifies the acoustic wave resulting in undesirable noise and vibration that may be noticeable to occupants within the passenger cabin. The compressor pulsation rattle can be reduced or eliminated by increasing the mass flow rate of refrigerant to the suction side.

To compensate for the occasional low mass flow rate of the vapor refrigerant to the suction side of the compressor, it is desirable for an air conditioning system to have a bypass device to augment the occasional low mass flow rate of the low pressure suction side with refrigerant from the high pressure discharge side of the compressor. It is further desirable to have such an air conditioning system that can augment the low mass flow rate of the low pressure side of the compressor on a self regulating, as needed basis. It is still even further desirable to have an existing component of the air conditioning system, such as the internal heat exchanger, that can accomplish the above mentioned functions.

SUMMARY OF THE INVENTION

The present invention relates to an internal heat exchanger assembly for an air conditioning system. The internal heat exchanger includes a housing having a first end, a second end axially opposed to the first end, and an interior surface therebetween defining a substantially cylindrical cavity for low pressure refrigerant flow. A helical coiled tube for high pressure refrigerant flow is disposed about the axis within the cylindrical cavity. A bleed valve assembly is integrated with a portion of the helical coil, in which the bleed valve assembly is adapted to open when the pressure differential between the high pressure side and low pressures side drops below a predetermined threshold. A drop in the pressure differential is an indication of low mass flow rate of refrigerant to the suction side of the compressor. The bleed valve assembly is also adapted to close when the pressure differential between the high pressure side and low pressures side rises above the predetermined threshold.

The bleed valve assembly includes a valve body having an inlet, an outlet, and an internal valve body surface therebetween defining a passageway for the high pressure refrigerant flow. The passageway includes an aperture and a valve seat circumscribing the aperture on the internal valve body surface. A valve head is positioned within the passageway and is adapted to engage the valve seat to form a hermetic seal between the high pressure side and low pressure side. Extending from the valve head substantially perpendicular to the aperture is a valve stem.

A biasing mean is adapted to engage the valve stem to urge the valve head apart from the valve seat when the pressure differential between the high pressure side and the low pressure side drops below the predetermined threshold. The biasing mean is further adapted to allow the valve head to move back toward the valve seat when the pressure differential rises above the predetermined threshold, thereby hermetically closing off the aperture.

The bleed valve assembly releases the high pressure refrigerant into the cylindrical cavity to augments the occasional low mass flow rate and pressure of the low pressure refrigerant to the suction side of the compressor in order to reduce or eliminate compressor rattle.

Further features and advantages of the invention will appear more clearly on a reading of the following detailed description of an embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
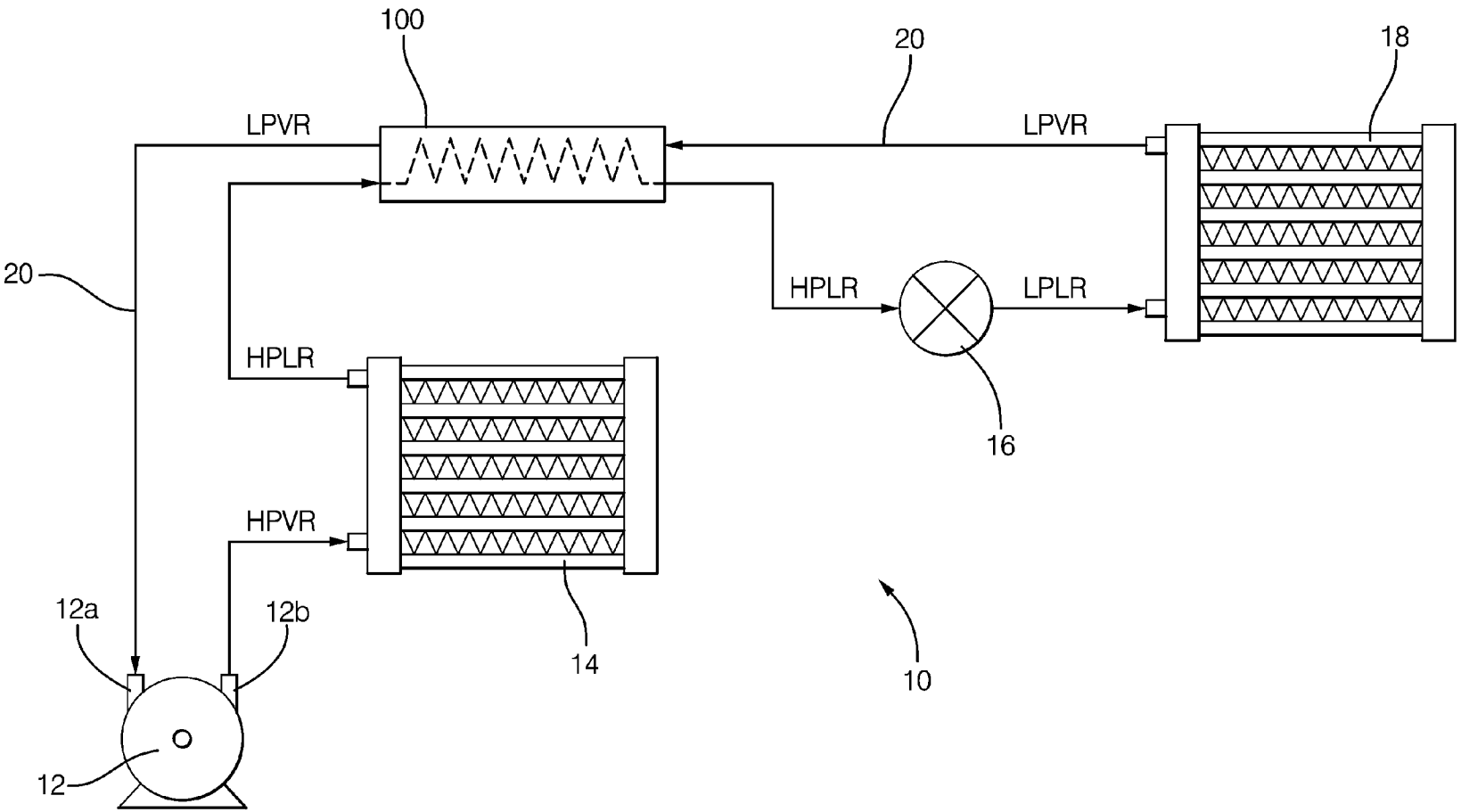
FIG. 1 is an automotive air conditioning system having an internal heat exchanger assembly that uses the lower temperature refrigerant exiting the evaporator to cool the higher temperature refrigerant exiting the condenser prior to an expansion device.

In accordance with a preferred embodiment of this invention, referring to FIGS. 1 through 4, is an internal heat exchanger assembly 100 for an automotive system air conditioning system 10, in which the internal heat exchanger assembly 100 includes a cylindrical cavity 130 for low pressure vapor refrigerant (LPVR) flow and a helical coiled tube 108 disposed within the cylindrical cavity 130 for high pressure liquid refrigerant (HPLR). The helical coiled tube 108 includes a bleed valve assembly 200 that releases the HPLR into the cylindrical cavity 130 to augment the occasional low mass flow rate and pressure of the LPVR refrigerant to the suction side 12*a* of the compressor 12, the benefits of which will be discussed in greater detail below.

Shown in FIG. 1 is an automotive air conditioning system 10 that includes a compressor 12, condenser 14, an expansion device 16, an evaporator 18, and an internal heat exchanger assembly 100 hydraulically connected in series by refrigerant tubes 20.

The compressor 12 is responsible for compressing and transferring the refrigerant throughout the system. The compressor includes a suction side 12*a* having a suction reed valve assembly (not shown) and a discharge side having a discharge reed valve assembly (not shown). The suction side 12*a* is commonly referred to as the low pressure side and the discharge side is commonly referred to as the high pressure side. LPVR exiting from the evaporator 18 is drawn and compressed by the compressor 12 into a high pressure vapor refrigerant (HPVR), which is then discharged to the condenser 14. Within the condenser 14, the HPVR is condensed to a HPLR. The HPLR then passes through an expansion device 16 that regulates the flow of the low pressure liquid refrigerant (LPLR) to the evaporator 18, in which the LPLR expands into the LPVR as it absorbs heat from the cabin of an automobile.

The internal heat exchanger assembly 100 uses the relatively lower temperature LPVR exiting the evaporator 18 to pre-cool the relatively higher temperature HPLR exiting the condenser 14 prior to the expansion device 16. The temperature of the returning LPVR to the compressor 12 from the evaporator 18 is typically 40° F. to 100° F. lower than the HPLR exiting the condenser 14. Shown in FIG. 1, the flow of LPVR from evaporator 18 is counter-current to the flow of HPLR from condenser 14 through internal heat exchanger assembly 100. An alternative embodiment (not shown) is that the flow of LPVR is concurrent with the flow of HPVR.

Figure 2:
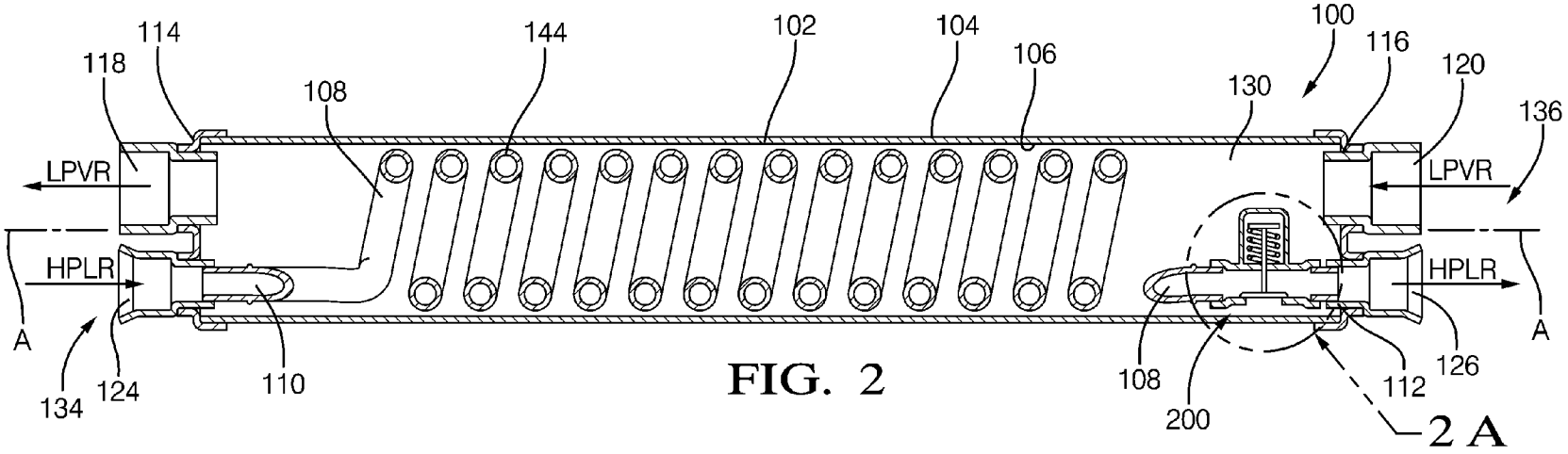
FIG. 2 is a cross sectional view of the internal heat exchanger assembly of FIG. 1 showing a housing defining an internal cavity for low pressure refrigerant flow, a helical coiled tube coaxially located within the cavity for high pressure refrigerant flow, and a bleed valve assembly incorporated in the helical coiled tube for selective hydraulic communication between the high pressure side and low pressure side.

Shown in FIG. 2 is a cross sectional side view of the internal heat exchanger assembly 100. The internal heat exchanger assembly 100 includes a housing 102 having a cavity 130 for LPVR flow, an internal helical coiled tube 108 coaxially positioned within the cavity 130 for HPLR flow, and a bleed valve assembly 200 that selectively bleeds the HPLR from the helical coiled tube 108 to augment the occasional low mass flow rate of the LPVR in the cavity 130 on a self regulating, as needed basis. Hydraulically sealing the housing 102 are end caps 114, 116. Each of the end caps 114, 116 includes a port 118, 120 and a tube coupling 124, 126.

The housing 102 includes an exterior surface 104, an interior surface 106, a first end 134, and a second end 136. The interior surface 106 defines a substantially cylindrical cavity 130 disposed about Axis A. The exterior surface 104 of the housing 102 also has a substantially cylindrical shape; however, the shape of the exterior surface 104 of the housing 102 may be any shape provided that it is capable of accommodating a preferably cylindrical shaped cavity.

Co-axially disposed within housing 102 is a single tube spiraled about axis A to provide the helical coiled tube 108. Helical coiled tube 108 includes a first tube end 110 that extends toward the first end 134 of the housing 102 and substantially parallel to Axis A. Helical coiled tube 108 also includes a second tube end 112 extending in a direction opposite that of the first tube end 110 and toward the second end 136 of the housing 102. The helical coiled tube 108 is sized to fit within they cylindrical cavity 130 while providing for an annular gap 144. The annular gap 144 provides a substantially unobstructed pathway for LPVR flow through cylindrical cavity 130; thereby, improving the overall heat transfer and decreasing the pressure drop through the cylindrical cavity 130 significantly.

The relatively cooler LPVR from evaporator 18 is introduced into cylindrical cavity 130 through one of the ports 118, 120. The relatively hotter HPLR discharge from the condenser 14 is introduced into the helical coiled tube 108 via one of the tube ends 110, 112. Heat is transferred from the HPLR in helical coiled tube 108 to the LPVR in the cylindrical cavity 130 via conduction by counter-current or concurrent refrigerant flow.

In a typical automotive air conditioning system, the HPLR exiting the condenser 14 positioned on the discharge side 12*b* of the compressor 12 and flowing within the helical coiled tube 108 has an operating pressure range of 200 to 400 psig, with an occasional low of 150 to 180 psig during periods of low demand. The LPVR exiting the evaporator and flowing through the cylindrical cavity 130 to the suction side 12*a* of the compressor 12 has an operating pressure of approximately 30 to 40 psig.

During periods of low demand on the air conditioning system 10, the overall refrigerant mass flow rate and pressure throughout the system is reduced accordingly by the compressor 12. When the HPLR at the discharge side of the condenser 14 drops below 180 psig, it causes instability in the compressor's suction reed valve assembly. The instability is the result of the suction reed valve assembly fluttering between a partially closed position and a partially open position. The fluttering of the suction reed valve assembly creates an acoustic wave that is transmitted upstream by the refrigerant tubes 20 back through the internal heat exchanger assembly 100 and towards the evaporator 18. The evaporator 18 amplifies the acoustic wave, resulting in what is perceived by occupants within the passenger cabin as undesirable harsh noise and vibration. The instability of the suction reed valve assembly may be reduced or eliminated by increasing the mass flow rate of the LPVR to the normal designed operating criteria of the compressor.

Figure 2B:
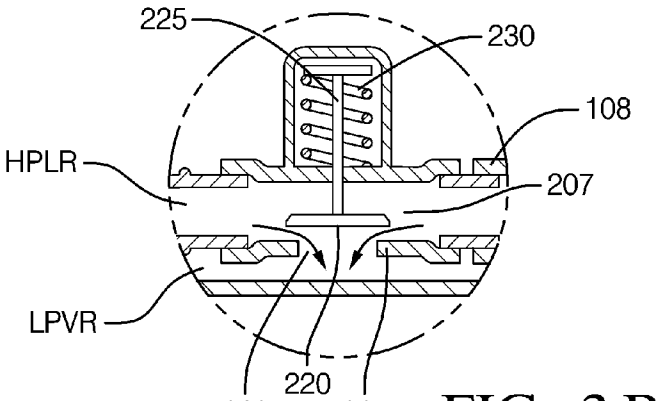
FIG. 2B is a detail view of the bleed valve assembly in an open position.

Incorporated into a portion of the helical coiled tube 108 of the internal heat exchanger 100 is a bleed valve assembly 200 that is in hydraulic communication with the HPLR flowing within the helical coiled tube 108 (high pressure side) and the LPVR flowing within the cylindrical cavity 130 (low pressure side). Shown in FIG. 2A, the bleed valve assembly 200 is set in a normally closed position when the pressure differential of the HPLR relative to the LPVR is at or above a predetermined threshold, which would be about 150 PSIG for a typical automotive air conditioning system. Once the pressure differential drops below the predetermined threshold, as shown in FIG. 2B, the bleed valve assembly 200 opens and by-passes a relatively small amount of the HPLR into the cylindrical cavity 130 to increase the refrigerant pressure and mass flow rate to the suction side of the compressor 12, thereby restoring stability to the suction reed valve assembly.

When the bleed valve assembly 200 is in the open state, the compressor senses an increase in pressure and mass flow rate of LPVR to the suction side and in turn, increases the discharge pressure of the outgoing HPVR to the condenser 14 dramatically. In other words, when the pressure and mass flow rate of refrigerant to the suction side 12*a* of the compressor 12 is increased, the compressor 12 pumps more refrigerant (the variable pistons become fully stroked) to the meet the perceived increased demand of the air conditioning system 10, thereby increasing the discharged mass flow rate and discharge pressure. The increase in the discharge pressure of the HPVR in turn increases the HPLR pressure exiting the condenser 14 until the pressure differential between the HPLR and LPVR in the internal heat exchanger 100 rises above than the predetermined threshold. Once the pressure differential pressure is greater than the predetermined threshold, the bleed valve assembly 200 automatically closes and hermetically seals the high pressure side from the low pressure side.

Figure 2A:
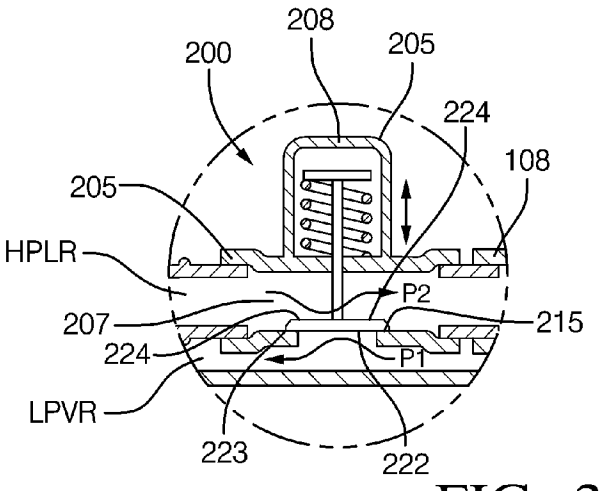
FIG. 2A is a detail view of the bleed valve assembly in a closed position.

Shown in FIG. 2A is a detailed embodiment of a bleed valve assembly 200 integrated into a portion of the helical coil 108, preferably the portion that extends substantially parallel to the A-axis. The bleed valve assembly 200 includes a valve body 205 that defines a passageway 207 for HPLR flow, a housing 208 for a biasing mean 230, an aperture 210, and a valve seat 215 on the interior surface of the valve body 205 circumscribing the aperture 210. Substantially perpendicular to the aperture 210 and within the passageway 207 is a valve head 220 adapted to hermetically seal the aperture 210 when the valve head 220 is engaged to the valve seat 215. The bleed valve assembly 200 also includes a valve stem 225 extending substantially perpendicular to the valve head 220 and into the housing 208. Disposed within the housing 208 and engaged with a portion of the valve stem 225 is a biasing means 230, such as a coiled spring, for urging the valve head 220 spatially apart from the valve seat 215 thereby exposing the aperture 210. When the aperture 210 is exposed, the HPLR flowing within the helical coil bleeds into the LPVR flowing in the cylindrical cavity to increase the mass flow rate and pressure of the refrigerant to the suction side 12*a* of the compressor 12.

The valve head 220 includes a first face 222 oriented toward the aperture 210 and a second face 224 oriented toward the biasing means 230. The first face 222 includes a perimeter 223 that is adapted to engage the valve seat 215 to form a hermetic seal. Extending from the second face 224 of the valve assembly head is the valve stem 225. Engaged to the valve assembly stem is the biasing mean 230 that urges the valve stem 225 and attached valve head 220 spatially apart from the aperture.

The pressure of the LPVR (P1) flowing in the cylindrical cavity 130 acts on the first face 222 of the valve head 220 to generate a first force (F1) that urges the valve head 220 in a first direction which is spatially apart from the aperture 210. The pressure of the HPLR (P2) flowing in the helical coiled tube 108 acts on the second face 224 to generate a second force (F2) that urges the valve head 220 in a second direction which is opposite the first direction, toward the aperture 210. Since P2 is much greater than P1, and the first and second faces 222, 224 have substantially equal surface areas, the second force F2 will be greater than the first force F1 and thereby will maintain the valve assembly head in a closed position during normal operating conditions. The biasing mean 230 induces a third force F3 equivalent to the second force F2 minus the first force F1 to assist urging the valve in the first direction, apart from the aperture 210. The amount of F3 required can be selected to open the valve assembly 200 at a predetermined pressure differential between P1 and P2.

For the automotive air conditioning system 10 described above, the desired normal operating pressure of the high pressure side P2 is greater than 180 PSIG and the low pressure side is greater than 30 PSIG, to prevent suction valve flutter. When the high pressure side drops below 180 PSIG, the compressor senses a low demand and decreases the pistons' output stroke rate, resulting in a decrease in refrigerant pressure and mass flow rate throughout the air conditioning system 10. The high pressure side P2 decreases at a rate much greater rate than the decrease in the low pressure side P1. The biasing means 230 can be set at a threshold where the pressure differential (between high pressure side P2 and low pressure side P1) drops below a predetermined threshold in order to urge the valve assembly 200 into an open position. In other words, once the pressure differential (P2–P1) drops below the predetermined threshold, the bleed valve assembly 200 opens.

In the instant example where P1 is greater than 30 psig and P2 is greater than 180 psig during normal operating conditions, the valve assembly 200 opens when the pressure differential (P2–P1) drops below 150 PSIG. At which time, the higher pressure HPLR flows into the cylindrical cavity 130 of the internal heat exchanger 100 to increase the pressure and flow rate of the refrigerant to the suction side 12*a* of the compressor 12. Once the compressor senses the increase in suction pressure, the compressor increases the discharge pressure and in turn, increases the pressure differential above 150 PSIG which then closes the valve assembly 200.

Figure 3:
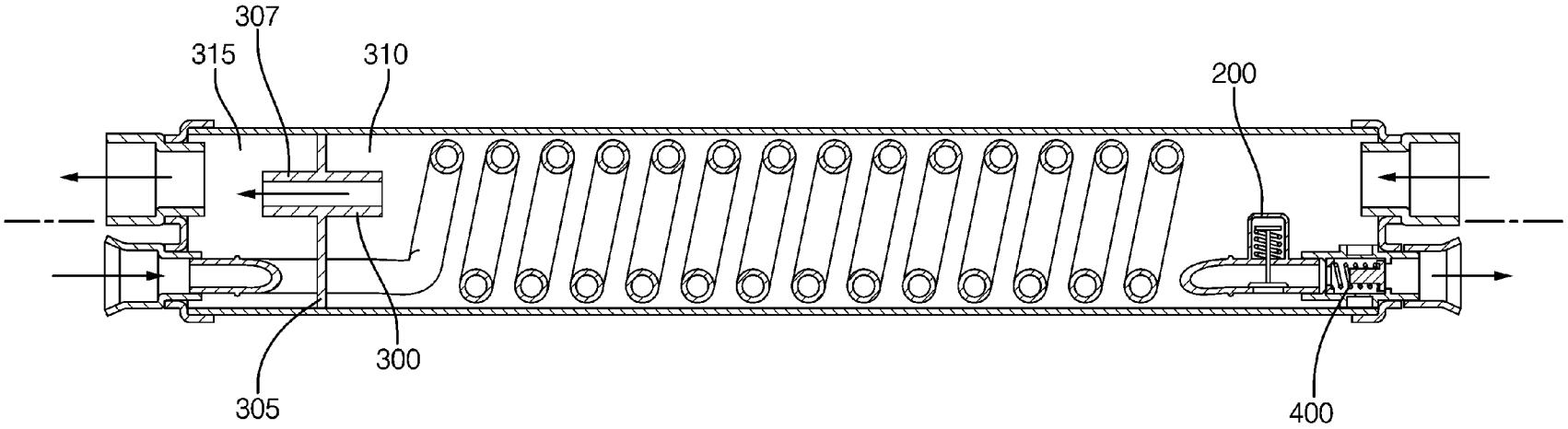
FIG. 3 is a cross sectional view of an alternative embodiment of the internal heat exchanger assembly of FIG. 2, in which the assembly also includes a muffler and an expansion valve assembly.

Shown in FIG. 3 is the internal heat exchanger assembly 100 having an integrated suction muffler assembly 300, which includes a bulk head 305 that partitions the internal cavity 130 into an upstream portion 310 and a downstream portion 315. The bulkhead 305 defines a bulkhead aperture through which extends a pipe 307 hydraulically connecting the upstream portion 310 to the downstream portion 315. The pipe 307 includes a diameter that is less than the diameter of the cylindrical cavity 130 of the internal heat exchanger 100.

Also shown in FIG. 3 is an expansion device 400 integrated into the discharge end of the helical coiled tube 108 and downstream of the bleed valve assembly 200. The integrated expansion device 400 eliminates the need of the expansion device 16 shown in FIG. 1.

Figure 4:
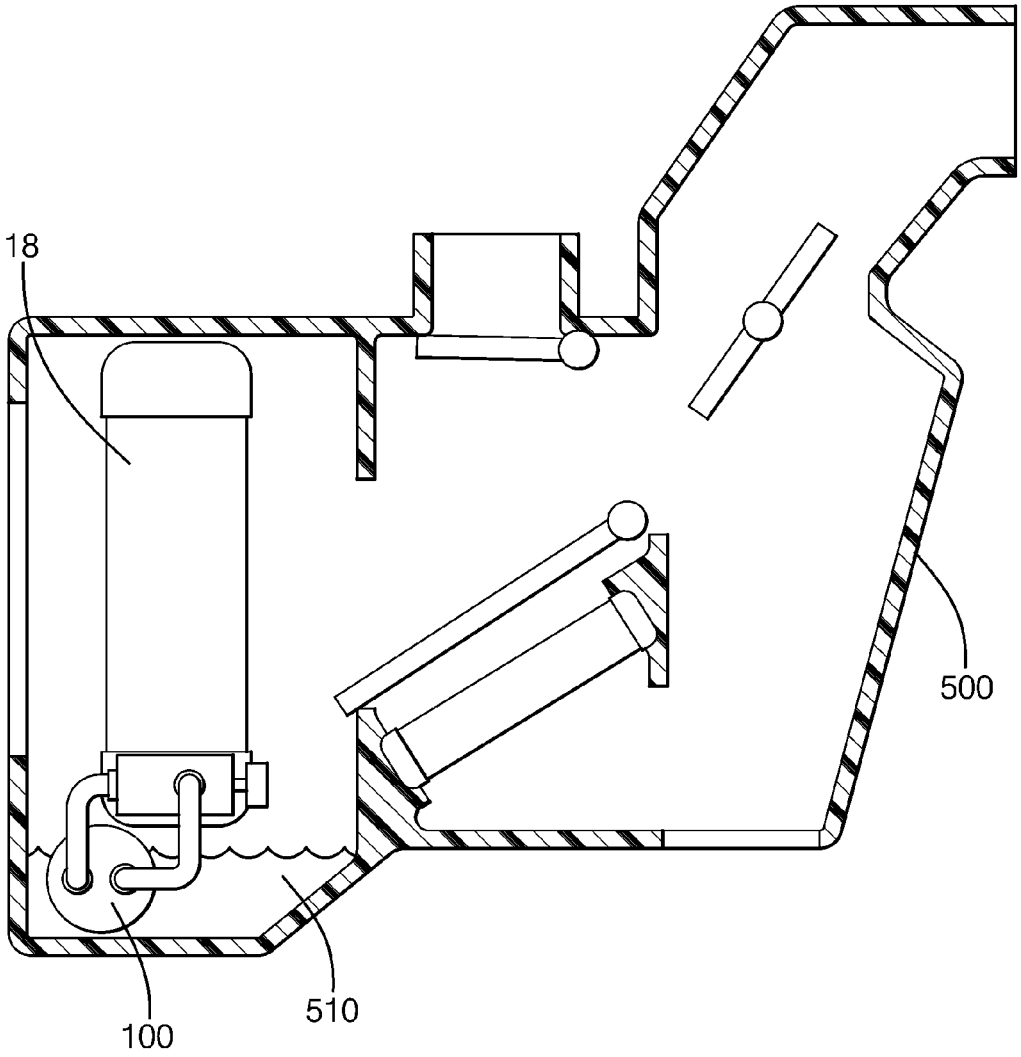
FIG. 4 is a cross sectional view of an automotive air conditioning module housing having a condensate sump, in which the internal heat exchanger assembly of FIG. 2 is shown submerged in the condensate sump.

Shown in FIG. 4 is a cross sectional view of a HVAC module housing 500 having a condensate sump. The internal heat exchanger assembly 100 is partially submerged in the condensate sump 510 defined by the HVAC module housing 500. The advantage of placing the internal heat exchanger assembly 100 in the condensate sump 510 is that it frees up valuable space under the engine compartment of an automobile, where the internal heat exchanger 100 is typically located. Another advantage is that the condensate further cools the internal heat exchanger 100 by evaporative cooling, thereby improving its overall performance.

An advantage of the internal heat exchanger disclosed herein is that it provides maximum heat transfer effectiveness within the internal heat exchanger and increased heat transfer capacity of the air conditioning system. Another advantage is that the internal heat exchanger includes a bypass to regulate the low pressure refrigerant entering the suction side of the compressor with high pressure refrigerant exiting the discharge side of the compressor. Still another advantage is that the internal heat exchanger selectively by-passes a portion of the HPLR from the helical coiled tube to the LPVR in the outer pipe to increase the pressure of the refrigerant entering the suction side of the compressor to reduce or eliminate compressor rattle.

While this invention has been described in terms of the preferred embodiments thereof, it is not intended to be so limited, but rather only to the extent set forth in the claims that follow.

Having described the invention herein, it is claimed:

1. An internal heat exchanger assembly for an air conditioning system comprising, a housing having a first end, a second end opposed to said first end, and an interior surface between said first end and said second end defining an elongated substantially cylindrical cavity along an axis configured to convey a low pressure refrigerant flow from an outlet of an evaporator to an inlet;

a helical coiled tube configured to convey a high pressure refrigerant flow from an outlet of said compressor to an inlet of said evaporator, wherein said tube is disposed within said cylindrical cavity;

a bleed valve assembly integrated into said tube, wherein said bleed valve assembly includes a biasing element urging a valve closure member of the bleed valve toward a closed position, a first face exposed to the low pressure refrigerant flow urging the closure member toward an open position, and a second faceexposed to the high pressure refrigerant flow urging the valve closure member toward the closed position, wherein the bleed valve assembly opens when a pressure differential between said high pressure refrigerant flow and said low pressure refrigerant flow drops below a threshold determined by the biasing element, thereby releasing high pressure refrigerant flow from said tube into said low pressure refrigerant flow within said cavity to augment a mass flow rate and pressure of the low pressure refrigerant to the inlet of the compressor, and closes when the pressure differential between said high pressure refrigerant flow and said low pressure flow rises above said predetermined threshold, and, an expansion valve integrated with said helical coil downstream from said bleed valve assembly.

2. The internal heat exchanger assembly of claim 1, wherein the valve closure member and the biasing element define a valve moving axis transverse to a direction of the low pressure refrigerant flow along the helical coiled tube.

3. The internal heat exchanger assembly of claim 2, wherein the valve closure member is arranged inside the helical tube and is operable to close an aperture in a wall of the helical tube, the wall forming a separation between the low pressure refrigerant flow and the high pressure refrigerant flow within the cylindrical cavity.

4. The internal heat exchanger assembly of claim 3, wherein the biasing element is a compression spring arranged in a housing adjacent to the helical tube and protruding into the cylindrical cavity, wherein a stem connected to the valve closure member extends from the helical tube into the housing.

* * * * *